US005113078A

United States Patent [19]

Takashi et al.

[11] Patent Number: 5,113,078

[45] Date of Patent: May 12, 1992

[54] RADIATION SHIELDING STRUCTURE

[75] Inventors: Yoshiharu Takashi; Yoshiyuki Kihara, both of Ibaraki, Japan

[73] Assignee: Doryokuro Kakunenryo Kaihatsu Jigyodan, Tokyo, Japan

[21] Appl. No.: 619,580

[22] Filed: Nov. 29, 1990

[30] Foreign Application Priority Data

Jan. 12, 1989 [JP] Japan ..... 1-310517

[51] Int. Cl.[5] ..... G21F 7/03

[52] U.S. Cl. ..... 250/515.1; 250/517.1

[58] Field of Search ..... 250/515.1, 516.1, 517.1, 250/519.1, 506.1, 505.1

[56] References Cited

U.S. PATENT DOCUMENTS

| | | | |
|---|---|---|---|
| 2,223,118 | 11/1940 | Miller | 250/517.1 |
| 3,045,120 | 7/1962 | Ohrn | 250/517.1 |
| 3,149,234 | 9/1964 | Hood et al. | 250/517.1 |
| 4,153,845 | 5/1979 | Fava | 250/517.1 |
| 4,156,146 | 5/1979 | Imai et al. | 250/515.1 |
| 4,292,419 | 9/1981 | Kamada et al. | 250/517.1 |

FOREIGN PATENT DOCUMENTS

| | | | |
|---|---|---|---|
| 61-230095 A | 4/1985 | Japan | 250/517.1 |

OTHER PUBLICATIONS

Proceedings of the Ninth Conference on Hot Laboratories and Equipment (Sponsored by the Hot Laboratory Division of the ANS), Chicago, Illinois, 7th-9th Nov. 1961, pp. 64-70; L. R. Kelman et al.: "Gloveboxes for plutonium metallurgy research at argonne national laboratory".

*Primary Examiner*—Jack I. Berman
*Assistant Examiner*—Kiet T. Nguyen
*Attorney, Agent, or Firm*—Armstrong, Nikaido, Marmelstein et al.

[57] ABSTRACT

A radiation shielding structure including a radiation shielding panel which comprises a lead transparent plate, for example, a transparent lead acrylic resin plate, lead glass plate, etc., and a thin nonlead transparent plate, for example, a transparent acrylate resin plate, glass plate, etc., which is laminated on at least one side of the lead transparent plate. Thus, lead that is contained in the lead transparent plate shields radioactive rays, while the nonlead transparent plate, which is laminated on at least one side of the lead transparent plate, prevents oxidation of the lead in the lead transparent plate by air or chemicals, which oxidation would otherwise form an oxide film on the panel surface and make the panel opaque.

3 Claims, 3 Drawing Sheets

RADIATION SHIELDING STRUCTURE

BACKGROUND OF THE INVENTION

The present invention relates to a transparent radiation shielding structure which may be used for, for example, a work face of a glove box that is designed to handle radioactive substances safely.

We will hereinafter discuss a work face of a glove box for handling radioactive substances in nuclear facilities as a prior art that is related to the present invention. However, it should be noted that the application of the present invention is not necessarily limited thereto and that the invention maybe generally applied to radiation shielding structures that are required to be transparent.

Referring to FIG. 2, a conventional glove box 21 has a work face 22, which is formed with glove ports 23 having gloves (not shown) attached thereto and passing therethrough, and a worker, using the gloves, handles a radioactive substance in the box.

The work face 22 of the glove box 21 must be capable of shielding radiation and also transparent so that the worker can view the inside of the box 21. In addition, the work face 22 must have a satisfactorily airtight structure.

The conventional work face 22 has a double-panel structure comprising an airtight panel 24 made of a transparent acrylate resin material and a radiation shielding panel 25 of a transparent lead acrylic resin material (or lead glass) that is disposed outside the airtight panel 24, as shown in FIG. 3.

The airtight panel 24 is brought into contact with a panel mounting portion 27 through a gasket 26 for airtight seal that is fitted to the outer peripheral edge of the panel 24. In addition, a retaining plate 29 is pierced with a plurality of bolts 28 that are provided on the panel mounting portion 27, and the airtight panel 24 is fastened with a nut 30 through the retaining plate 29, thereby securing the airtight panel 24 to the panel mounting portion 27.

The transparent radiation shielding panel 25 is disposed outside the airtight panel 24 to shield radioactive rays, e.g., neutron beams, gamma rays, etc., by lead that is contained in the radiation shielding panel 25.

The reason why the prior art adopts the double-panel structure comprising the airtight panel 24 and the radiation shielding panel 25 is that, if the radiation shielding panel 25 is attached directly to the panel mounting portion 27 through the gasket 26, which is fitted to the outer peripheral edge of the panel 25, to form a single-panel structure, lead that is contained in the radiation shielding panel 25 is oxidized by chemicals, e.g., nitric acid, in the box 21 to form an oxide film on the panel surface, resulting in the panel 25 becoming opaque, so that it becomes difficult to view the inside of the box 21.

The above-described prior art suffers, however, from the problems stated below.

Since a gap 31 is present between the airtight panel 24 and the radiation shielding panel 25, which constitute a double-panel structure, the opposing surfaces 24*a* and 25*a* of the two panels 24 and 25 become cloudy with moisture or are stained with suspended dust, resulting in a lowering in the transparency. In addition, radiation cannot be shielded at the edge of the gap 31 between the airtight panel 24 and the radiation shielding panel 25, so that radioactive rays leak therethrough. Further, since two panels 24 and 25 need to be mounted, the assembly operation efficiency is low.

SUMMARY OF THE INVENTION

It is a first object of the present invention to provide a radiation shielding structure which is designed so that it is possible to shield radiation by a single panel and still prevent lowering in the transparency due to oxidation, thereby eliminating the problem of lowering in the transparency due to the gap between two panels of the conventional double-panel structure and the problem of the leakage of radioactive rays from the peripheral edge of the gap between the two panels, and thus improving the efficiency of the panel mounting operation.

It is a second object of the present invention to provide a radiation shielding structure which is designed so that it is possible to mount the panel stably in the single-panel radiation shielding structure.

It is a third object of the present invention to provide a radiation shielding structure which is designed so that it is possible to prevent the panel from being damaged by a retaining plate that holds the outer peripheral edge of the panel in the single-panel radiation shielding structure.

It is a fourth object of the present invention to provide a radiation shielding structure which is designed so that it is possible to prevent displacement of a gasket in the single-panel radiation shielding structure.

It is a fifth object of the present invention to provide a radiation shielding structure which is designed so that it is possible to improve the airtightness in the single-panel radiation shielding structure.

To attain the above-described objects, the present invention provides a radiation shielding structure which comprises a lead transparent plate and a nonlead transparent plate which is laminated on at least one side of the lead transparent plate.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Figure 1:
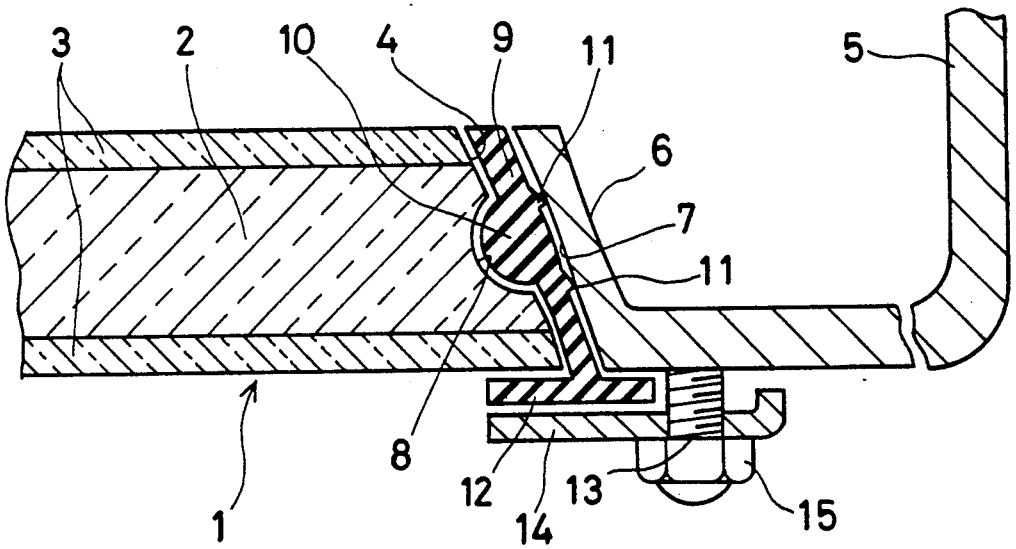
FIG. 1 is a sectional view of one embodiment of the radiation shielding structure according to the present invention.
Figure 2:
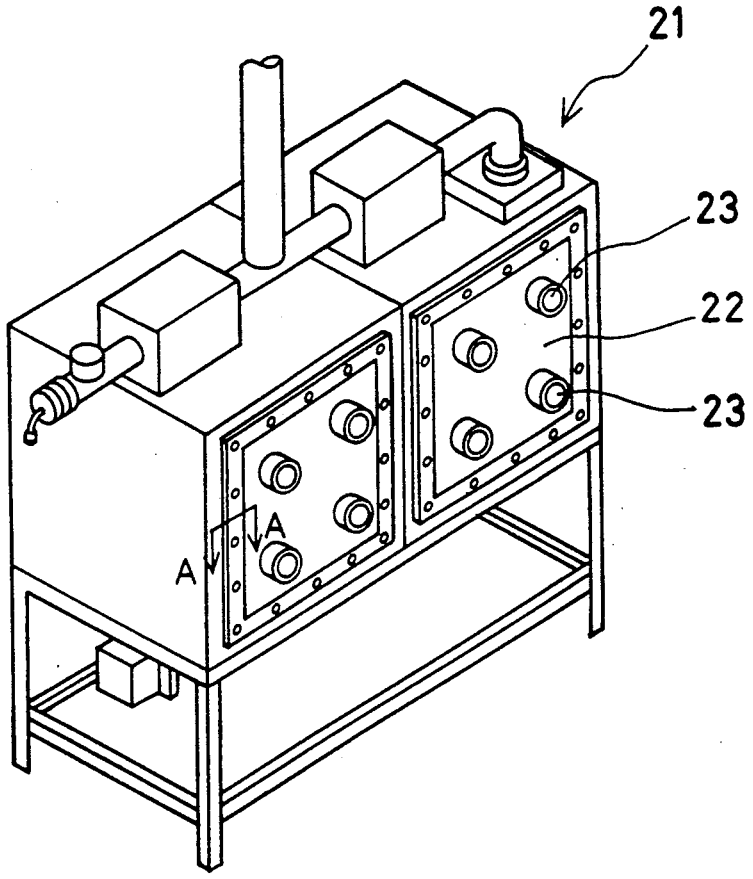
FIG. 2 is a perspective view of a conventional glove box.
Figure 3:
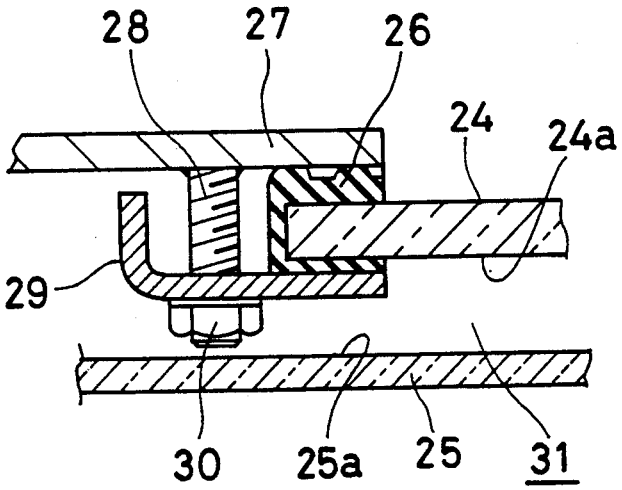
FIG. 3 is a sectional view taken along the line A—A of FIG. 2.

One embodiment of the present invention will be described below with reference to FIG. 1.

A radiation shielding panel 1, which constitutes the radiation shielding structure of the present invention, comprises a lead transparent plate 2, for example, a transparent lead acrylic resin plate, lead glass plate, etc., and a thin nonlead transparent plate 3, for example, a transparent acrylate resin plate, glass plate, etc., which is laminated on at least one side of the lead transparent plate 2. Thus, lead that is contained in the lead transparent plate 2 shields radioactive rays, while the nonlead transparent plate 3 prevents oxidation of the lead in the lead transparent plate 2 by air or chemicals, for example, nitric acid, which oxidation would otherwise form an oxide film on the panel surface and make the panel 1 opaque.

It is preferable from the viewpoint of mechanical strength and machinability to employ a lead acrylic resin plate as the lead transparent plate 2 and an acrylate resin plate as the nonlead transparent plate 3, which is laminated on the lead acrylic resin plate.

The outer peripheral edge of the radiation shielding panel 1 is formed with a taper 4 that serves as a guide when the panel 1 is mounted, and the inner peripheral edge of a panel mounting portion 6 of a box frame 5 is also formed with a taper 7 as a guide for mounting, so that the radiation shielding panel 1 is fitted into the panel mounting portion 6 by being guided by the tapers 4 and 7.

In addition, the outer peripheral edge of the radiation shielding panel 1 is provided with a gasket fitting recess 8 which is in the form of a groove, and a positioning projection 10 that is integrally formed on the inner peripheral edge of the gasket 9 is fitted into the gasket fitting recess 8, thereby enabling the gasket 9 to be attached to the radiation shielding panel 1.

The outer peripheral edge of the gasket 9 is provided with a plurality of contact projections 11 having an acute triangle-shaped cross-section with a view to enhancing the adhesion between the gasket 9 and the panel mounting portion 6 and thereby improving the airtightness. The gasket 9 further has a buffer portion 12, as an integral part thereof, which is interposed between the radiation shielding panel 1 and a retaining plate 14 (described later) to prevent the radiation shielding panel 1 from being damaged by the retaining plate 14. A plurality of bolts 13 are attached to the peripheral edge of the panel mounting portion 6 by means, for example, of welding. The retaining plate 14 is pierced with the bolts 13 and brought into contact with the boundary between the radiation shielding panel 1 and the panel mounting portion 6, and the radiation shielding panel 1 is secured to the panel mounting portion 6 through the retaining plate 14 and the buffer portion 12 of the gasket 9 by nuts 15 that are screwed onto the bolts 13.

Although in this embodiment the bolts 13 and the nuts 15 are employed as fastening means for securing the radiation shielding panel 1 through the retaining plate 14, any other fastening means may be employed, as a matter of course.

This embodiment, arranged as described above, functions as follows.

In the radiation shielding panel 1, lead that is contained in the lead transparent plate 2 shields radioactive rays, while the nonlead transparent plate 3, which is laminated on at least one side of the lead transparent plate 2, prevents oxidation of the lead in the lead transparent plate 2 by air or chemicals, which oxidation would otherwise form an oxide film on the panel surface and make the panel opaque. Since the work face comprises only the radiation shielding panel 1, the radiation shielding structure of the present invention is free from the problem of lowering in the transparency due to the moisture or suspended dust in the gap between two panels of the conventional double-panel structure, and it is also free from the problem of leakage of radioactive rays through the gap between the two panels of the prior art. In addition, it is possible to improve the efficiency of the panel mounting operation.

Since the radiation shielding panel 1 is fitted into the panel mounting portion 6 by being guided by the tapers 4 and 7, the efficiency of the panel mounting operation improves and the panel 1 can be mounted even more stably. Since the positioning projection 10 of the gasket 9 is fitted into the gasket fitting recess 8 in the radiation shielding panel 1, displacement of the gasket 9 is prevented. Since the contact projections 11 of the gasket 9 come into close contact with the inner peripheral edge of the panel mounting portion 6, the airtightness improves. In addition, since the buffer portion 12 of the gasket 9 is interposed between the retaining plate 14 and the radiation shielding panel 1, there is no danger of the radiation shielding panel 1 being damaged by the retaining plate 14.

The present invention provides the following advantages:

(1) In the radiation shielding panel, lead that is contained in the lead transparent plate shields radioactive rays, while the nonlead transparent plate, which is laminated on at least one side of the lead transparent plate, prevents oxidation of the lead in the lead transparent plate, which would otherwise form an oxide film on the panel surface and make the panel opaque. Since the lowering in the transparency due to such oxidation can be eliminated by the radiation shielding panel only, the radiation shielding structure of the present invention is free from the problem of lowering in the transparency due to the moisture or suspended dust in the gap between two panels of the conventional double-panel structure, and it is also free from the problem of leakage of radioactive rays through the gap between the two panels of the prior art. In addition, since the radiation shielding panel alone needs to be mounted, the panel mounting operation improves.

(2) Since the radiation shielding panel is fitted into the panel mounting portion by being guided by the tapers, the efficiency of the panel mounting operation improves and the panel can be mounted even more stably.

(3) Since the positioning projection of the gasket is fitted into the gasket fitting recess in the radiation shielding panel, displacement of the gasket is prevented.

(4) Since the contact projections of the gasket come into close contact with the panel mounting portion, the airtightness improves.

(5) Since the buffer portion of the gasket is interposed between the radiation shielding panel and the retaining plate, the radiation shielding panel is prevented from being damaged by the retaining plate.

What is claimed is:

1. A radiation shielding structure comprising:

a radiation shielding panel including a lead transparent plate and a nonlead transparent plate which is laminated on at least one side of said lead transparent plate; and a gasket which is fitted to the outer peripheral edge of said radiation shielding panel to hermetically seal the area between said radiation shielding panel and a panel mounting portion, wherein the outer peripheral edge of said radiation shielding panel is formed with a gasket fitting recess which is fitted with a positioning projection that is integrally formed on the inner peripheral edge of said gasket.

2. A radiation shielding structure comprising:

a radiation shielding panel including a lead transparent plate and a nonlead transparent plate which is laminated on at least one side of said lead transparent plate; and a gasket which is fitted to the outer peripheral edge of said radiation shielding panel to hermetically seal the area between said radiation shielding panel and a panel mounting portion, wherein the outer peripheral edge of said gasket is integrally formed with contact projections for improving the adhesion between said gasket and said panel mounting portion.

3. A radiation shielding structure according to claim 2, wherein the outer peripheral edge of said radiation shielding panel is formed with a gasket fitting recess which is fitted with a positioning projection that is integrally formed on the inner peripheral edge of said gasket.

* * * * *

UNITED STATES PATENT AND TRADEMARK OFFICE

CERTIFICATE OF CORRECTION

PATENT NO. : 5,113,078

DATED : May 12, 1992

INVENTOR(S) : Yoshiharu TAKAHASHI et al

It is certified that error appears in the above-identified patent and that said Letters Patent is hereby corrected as shown below:

On the title page, after item [19], "Takashi et al." should read -- Takahashi et al.--; and On title page, Item [75], first line, "Yoshiharu Takashi" should read --Yoshiharu Takahashi--.

Signed and Sealed this

Thirteenth Day of July, 1993

Michael K. Kirk

*Attest:*

MICHAEL K. KIRK

*Attesting Officer*

*Acting Commissioner of Patents and Trademarks*